US010371412B2

(12) United States Patent
Hanks et al.

(10) Patent No.: US 10,371,412 B2
(45) Date of Patent: Aug. 6, 2019

(54) FURNACE

(71) Applicant: TRANE INTERNATIONAL INC., Davidson, NC (US)

(72) Inventors: Andrew Hamilton Hanks, Tyler, TX (US); Nathan Wagers, Henderson, TX (US); Thomas Gort, Tyler, TX (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 15/974,946

(22) Filed: May 9, 2018

(65) Prior Publication Data

US 2018/0259221 A1 Sep. 13, 2018

Related U.S. Application Data

(63) Continuation of application No. 14/936,316, filed on Nov. 9, 2015, now Pat. No. 10,006,661.

(60) Provisional application No. 62/076,632, filed on Nov. 7, 2014.

(51) Int. Cl.

| | |
|---|---|
| ***F24D 5/02*** | (2006.01) |
| ***F24H 3/00*** | (2006.01) |
| ***F24H 3/08*** | (2006.01) |
| ***F24H 9/02*** | (2006.01) |
| ***F24H 9/06*** | (2006.01) |
| ***F24H 9/18*** | (2006.01) |
| ***F28D 7/08*** | (2006.01) |
| ***F28F 9/02*** | (2006.01) |
| ***F28F 9/013*** | (2006.01) |

(52) U.S. Cl.

CPC ..... *F24H 3/087* (2013.01); *F24D 5/02* (2013.01); *F24H 3/006* (2013.01); *F24H 9/02* (2013.01); *F24H 9/06* (2013.01); *F24H 9/1881* (2013.01); *F28D 7/082* (2013.01); *F28F 9/013* (2013.01); *F28F 9/0226* (2013.01); *F28F 2280/02* (2013.01)

(58) Field of Classification Search

CPC ..... F24H 3/006; F24H 3/025; F24H 3/065; F24H 3/087; F24H 3/105; F24H 9/02; F24H 9/06; F24H 9/1881; F24D 5/02

See application file for complete search history.

(56) References Cited

U.S. PATENT DOCUMENTS

| | | | |
|---|---|---|---|
| 2,263,098 | A | 11/1941 | Mueller |
| 2,642,857 | A | 6/1953 | Walter |
| 3,223,078 | A | 12/1965 | Miller et al. |
| 4,548,194 | A | 10/1985 | Schafer et al. |
| 4,924,848 | A | 5/1990 | Vaughn |

(Continued)

FOREIGN PATENT DOCUMENTS

WO 2010/019978 2/2010

*Primary Examiner* — David J Laux

(74) *Attorney, Agent, or Firm* — Hamre, Schumann, Mueller & Larson, P.C.

(57) ABSTRACT

A furnace is disclosed. The furnace may include an enclosure having a vertical support column formed by a heat exchanger compartment panel and a blower compartment panel. The furnace may include a window assembly having venting openings hidden by a viewing window. The furnace may also include a rail to support a removable heat exchanger system. The furnace may further include a wire retaining fin assembly to retain a wire. A heat exchanger header design including features to retain a sealant is also disclosed.

5 Claims, 15 Drawing Sheets

(56) References Cited

U.S. PATENT DOCUMENTS

| | | | | |
|---|---|---|---|---|
| 5,704,343 | A | 1/1998 | Ahn et al. | |
| 5,749,355 | A | 5/1998 | Roan et al. | |
| 5,775,318 | A | 7/1998 | Haydock et al. | |
| 5,799,646 | A | 9/1998 | Zia et al. | |
| 5,992,410 | A | 11/1999 | Raleigh et al. | |
| 6,036,480 | A * | 3/2000 | Hughes | F23D 14/24 122/249 |
| 6,474,329 | B1 | 11/2002 | Sears et al. | |
| 6,494,199 | B1 | 12/2002 | Zia et al. | |
| 2012/0031392 | A1 | 2/2012 | Deng | |
| 2012/0085334 | A1 * | 4/2012 | Beck | F24H 3/087 126/114 |
| 2012/0178031 | A1 | 7/2012 | Roy | |

* cited by examiner

FURNACE

FIELD

The disclosure herein relates to a furnace that may be included, for example, in a heating, venting and air conditioning (HVAC) system.

BACKGROUND

A furnace, such as a furnace in a HVAC system, typically includes a burner system, a heat exchanger system and a blower system. An enclosure of the furnace may be partitioned into a plurality of compartments to housing the components of the furnace.

SUMMARY

A furnace is disclosed. In some embodiments, the furnace may include an enclosure that includes a heat exchanger compartment that is vertically aligned with a blower compartment, and a combustion compartment that is positioned in a front section of the enclosure. In some embodiments, the heat exchanger compartment is positioned above the blower compartment in a vertical direction. In some embodiments, the combustion compartment may extend to about the same height as a height of the blower compartment and the heat exchanger compartment combined. In some embodiments, the enclosure may include a vertical support column formed by the vertically aligned heat exchanger compartment panel and blower compartment panel. The term "vertically aligned" generally refers to a situation that a side of one panel may be aligned with a side of another panel so that a straight line can be formed in the vertical orientation by the two sides of the panels. It is to be appreciated that the term "vertical" or "vertically" is relative to the orientations as shown in the drawings of this document. The embodiments as disclosed herein can be oriented differently in practice.

In some embodiments, the front section of a furnace may include a window assembly having an air vent covered by a viewing window panel, so that vent openings can be hidden by the viewing window panel. In some embodiments, the window assembly may include at least one tinted glass. In some embodiments, the window assembly may include a plurality of tinted glasses, each of which may provide a different view into the furnace.

In some embodiments, the furnace may include a rail to support a removable heat exchanger system.

In some embodiments, the furnace may include a wire retaining fin assembly to retain a wire. In some embodiments, the wire retaining fin assembly may include a first fin oppositely positioned from a second fin, where the first fin and second fin may have an offset space in between. In some embodiments, the first fin and the second fin can define a wire retaining space. The wire can be received in the offset space and then twisted into the wire retaining space.

In some embodiments, the furnace may include a heat exchanger header that includes a recessed region configured to retain a sealant.

Other features and aspects of the systems, methods, and control concepts will become apparent by consideration of the following detailed description and accompanying drawings.

BRIEF DESCRIPTION OF THE DRAWINGS

Reference is now made to the drawings in which like reference numbers represent corresponding parts throughout.

FIG. 2A illustrates the enclosure with some of the panels removed. FIG. 2B illustrates a schematic diagram showing an arrangement of different compartments in the enclosure.

FIG. 3A is a front view of the window assembly. FIG. 3B illustrates the air vent. FIG. 3C illustrates openings of the air vent, which is covered by a window assembly, and where the window assembly can be transparent. FIG. 3D illustrates a perspective close up view of the window assembly.

FIG. 4A is a front perspective view of the removable heat exchanger system installed on an enclosure using a rail. FIG. 4B is a partial perspective view of an enclosure with a view of the rail on the enclosure.

FIG. 5A illustrates the wire retaining fin assembly positioned on a blower assembly. FIG. 5B illustrates a side view of the wire retaining fin assembly, showing a wire retaining space that is configured to accommodate a wire. FIG. 5C is a close up view of the wire retaining fin assembly, showing an offset between two fins of the wire retaining fin assembly.

FIG. 6A illustrates a perspective view of the heat exchanger header. FIG. 6B illustrates a side section schematic view of a heat exchanger header. FIG. 6C illustrates a perspective view of the heat exchanger header of FIG. 6A with a cover of the header removed.

DETAILED DESCRIPTION

A furnace, for example, of a HVAC system typically includes a burner system, a heat exchanger system and a blower system. These systems are housed in an enclosure. Embodiments disclosed herein are directed to features of the furnace.

References are made to the accompanying drawings that form a part hereof, and in which is shown by way of illustration of the embodiments may be practiced. It is to be understood that the terms used herein are for the purpose of describing the figures and embodiments and should not be regarded as limiting the scope.

Figure 1:
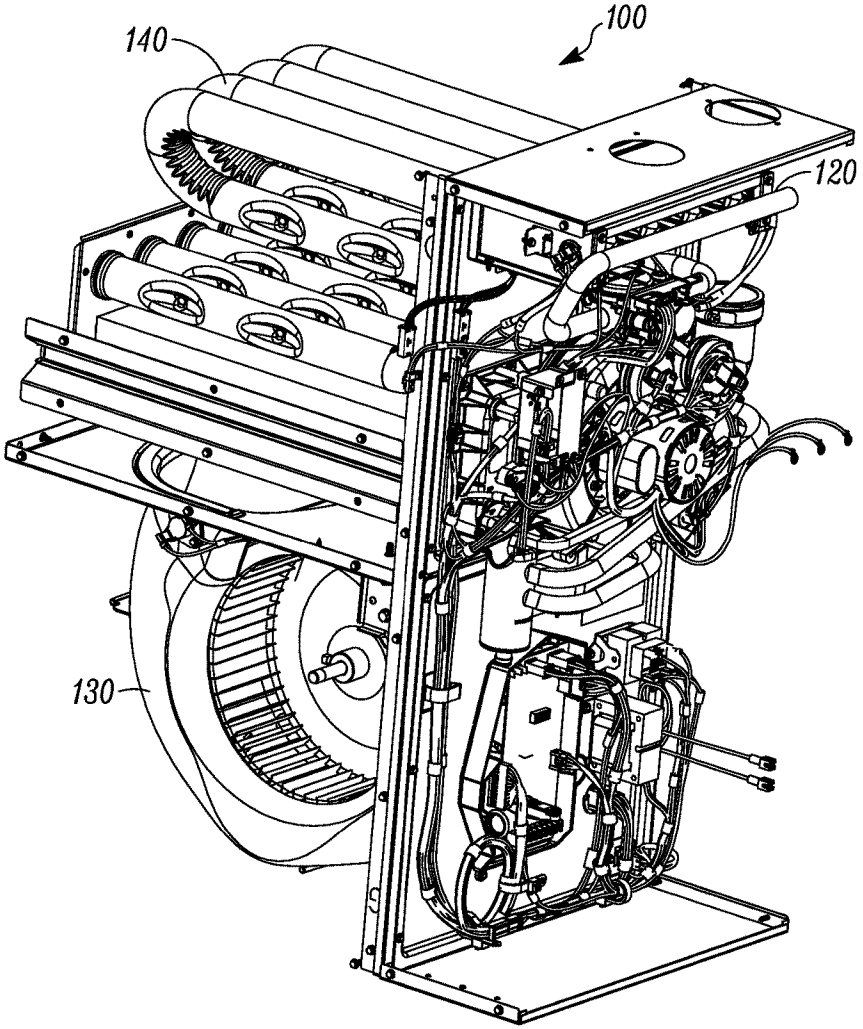
FIG. 1 illustrates an exemplary furnace, with which the embodiments as disclosed herein can be practiced.

FIG. 1 illustrates an exemplary furnace 100, with which the embodiments as disclosed herein can be practiced. The furnace 100 includes a burner system 120, a blower system 130 and a heat exchanger system 140. The furnace 100 will include an enclosure, with which the embodiments as disclosed herein can be practiced (see e.g. FIGS. 2A and 2B). The enclosure can be partitioned into one or more compartments to house the components (e.g. the burner system 120, the blower system 130 and the heat exchanger system 140, among other compartments) of the furnace 100.

Figure 2A:
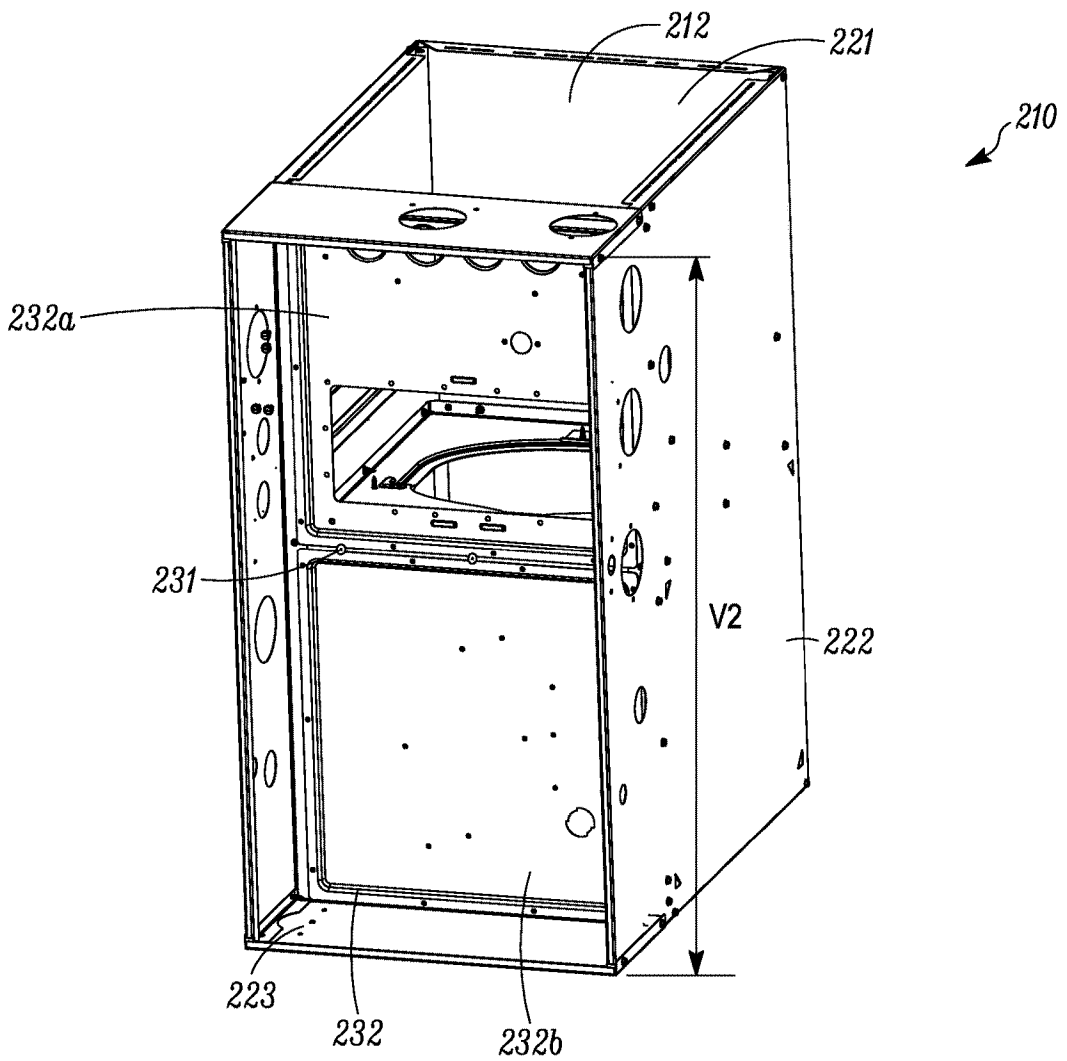
FIGS. 2A to 2B illustrate an enclosure of a furnace.
Figure 2B:
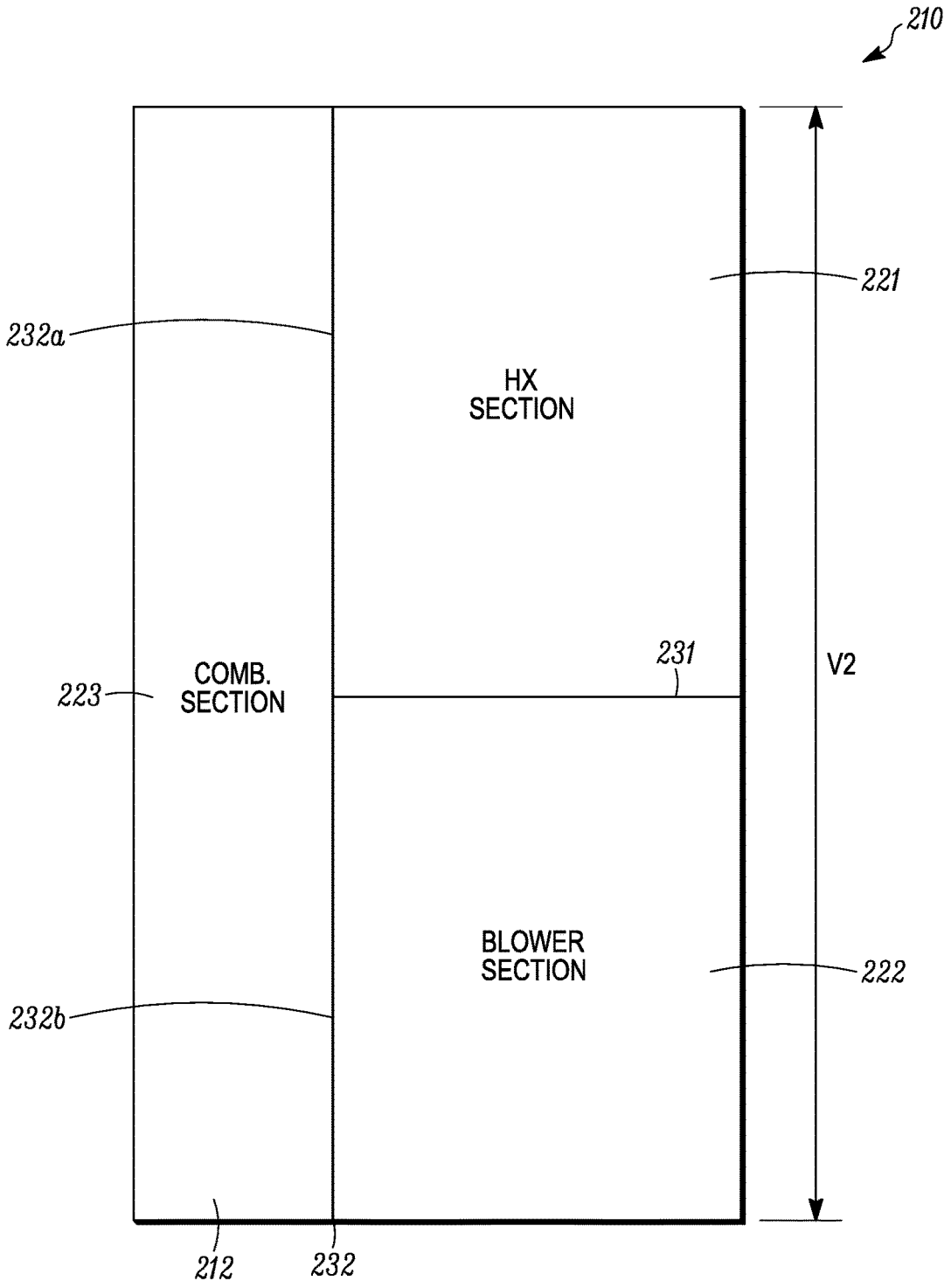

FIGS. 2A and 2B illustrate an embodiment of an enclosure 210 for a furnace. The enclosure 210 may be implemented for example with the furnace 100 shown in FIG. 1. The enclosure 210 has a space 212 that may be partitioned into a plurality of compartments: a heat exchanger compartment 221, a blower compartment 222, and a combustion compartment 223. These compartments may be configured to house, for example, a heat exchanger system (e.g. the heat exchanger 140 in FIG. 1), a blower system (e.g. the blower system 130 in FIG. 1) and a burner system (e.g. the burner system 120 in FIG. 1) respectively. It is to be appreciated that the enclosure can be configured differently to house different systems and/or components to, for example, meet different design requirements.

In the illustrated embodiment, the heat exchanger compartment 221 is positioned on top of the blower compartment 222 in a vertical orientation V2. The heat exchanger compartment 221 and the blower compartment 222 are aligned vertically. The term "aligned vertically" or "vertically aligned" generally refers to a situation that a side of one panel may be aligned with a side of another panel so that in some cases a straight line can be formed in the vertical orientation (e.g. the vertical orientation V2) by the two sides of the panels. It is to be appreciated that a thickness of the panels of the compartments may differ and so vertically aligned is also meant to include such overlap in the thicknesses of the side panels or walls but where the panels and/or walls are on top of each other to form a column structure.

It is to be appreciated that the term "vertical" or "vertically" is relative to the orientations as shown in the drawings of this document. The embodiments of the enclosures as disclosed herein can be oriented differently in practice.

A first panel 231, which is horizontally positioned relative to the vertical orientation V2, separates the heat exchanger compartment 221 and the blower compartment 222 in the vertical orientation V2.

The heat exchanger compartment 221 has a heat exchanger compartment panel 232*a*, and the blower compartment 222 has a blower compartment panel 232*b*. The blower compartment panel 232*b* is positioned to be vertically aligned with the heat exchanger compartment panel 232*a*, creating a vertical supporting column 232. The vertical supporting column 232 can help increase a structural strength of the enclosure 210. In an embodiment, the panels 232*a*, 232*b* can be separate pieces connected together or configured as an integrated piece.

The combustion compartment 223 is separated from the heat exchanger compartment 221 and the blower compartment 222 by the heat exchanger compartment panel 232*a* and the blower compartment panel 232*b* respectively, and is positioned in a front section of the enclosure 210 relative to the heat exchanger compartment 221 and the blower compartment 222. Relative to the vertical direction, the combustion compartment 223, in the illustrated embodiments, occupies the entire vertical direction. A height of the combustion compartment 223 is about the same as a combined height of the heat exchanger compartment 221 and the blower compartment 222. Compared to a traditional design, the combustion compartment 223 may be relatively larger in size, which can help an installation process or a service process, and may be helpful in various applications. The position and/or size of the combustion compartment 223 can help arrange the wiring, gas line configuration and/or condensate hose configuration. The blower compartment 222 can also get air from all directions of the enclosure 210. The relatively large combustion compartment 223 can also help access the serviceable components, e.g. the burner system).

The vertical support column 232 helps increase a structural strength of the enclosure 210. In practice, the enclosure 210 may be used in the orientation as shown in FIGS. 2A and 2B, for example where the height V2 is the majority dimension, relative for example to a depth or length direction. The enclosure 210 may also be used in other orientations that are different from the orientation as shown, such as for example, a relatively horizontal orientation relative to the vertical orientation as shown in FIGS. 2A and 2B where the enclosure has a length greater than the height. The vertical support column 232 can help enhance the structural strength in various orientations. The vertical support column 232 can also help reduce structural damage to the enclosure 210 during shipment.

In an embodiment, the furnace has a viewing window so that, for example, a fire of a burner, can be seen through the viewing window. In an embodiment, the furnace may include an air vent to supply air to the burner. FIGS. 3A to 3D illustrate a window assembly 300 including an air vent 310 covered by a viewing window panel 320. It is to be appreciated that the viewing window, the air vent, and the features thereof as disclosed herein can be used separately. In an embodiment, the viewing window is part of a viewing window assembly for a front door or access of the furnace, and the air vent is part of the front door or access of the furnace. The viewing window assembly and air vent may be implemented with an enclosure and furnace as shown in FIGS. 1 and 2.

Figure 3A:
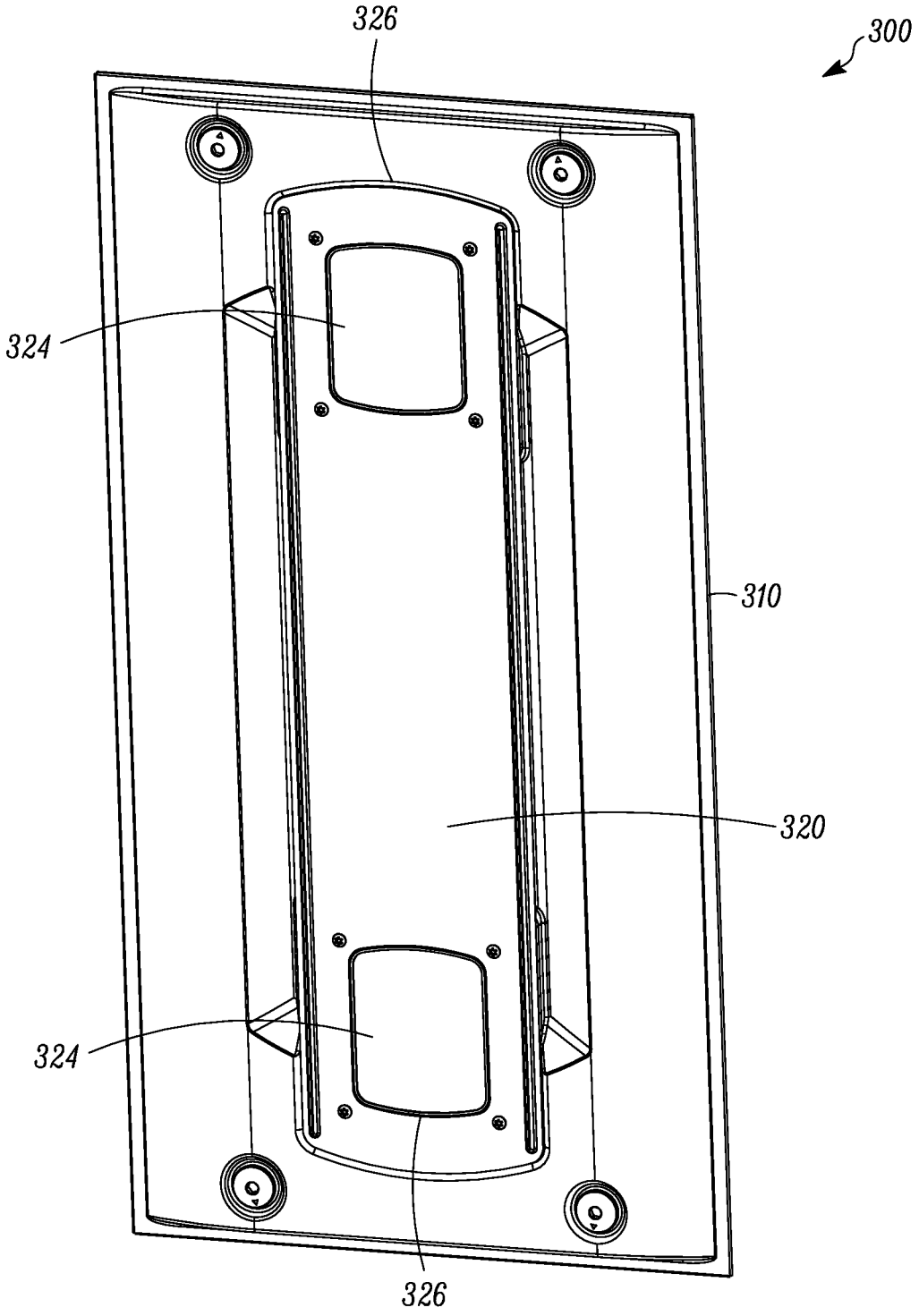
FIGS. 3A to 3D illustrate a window assembly including an air vent covered by a viewing window.
Figure 3B:
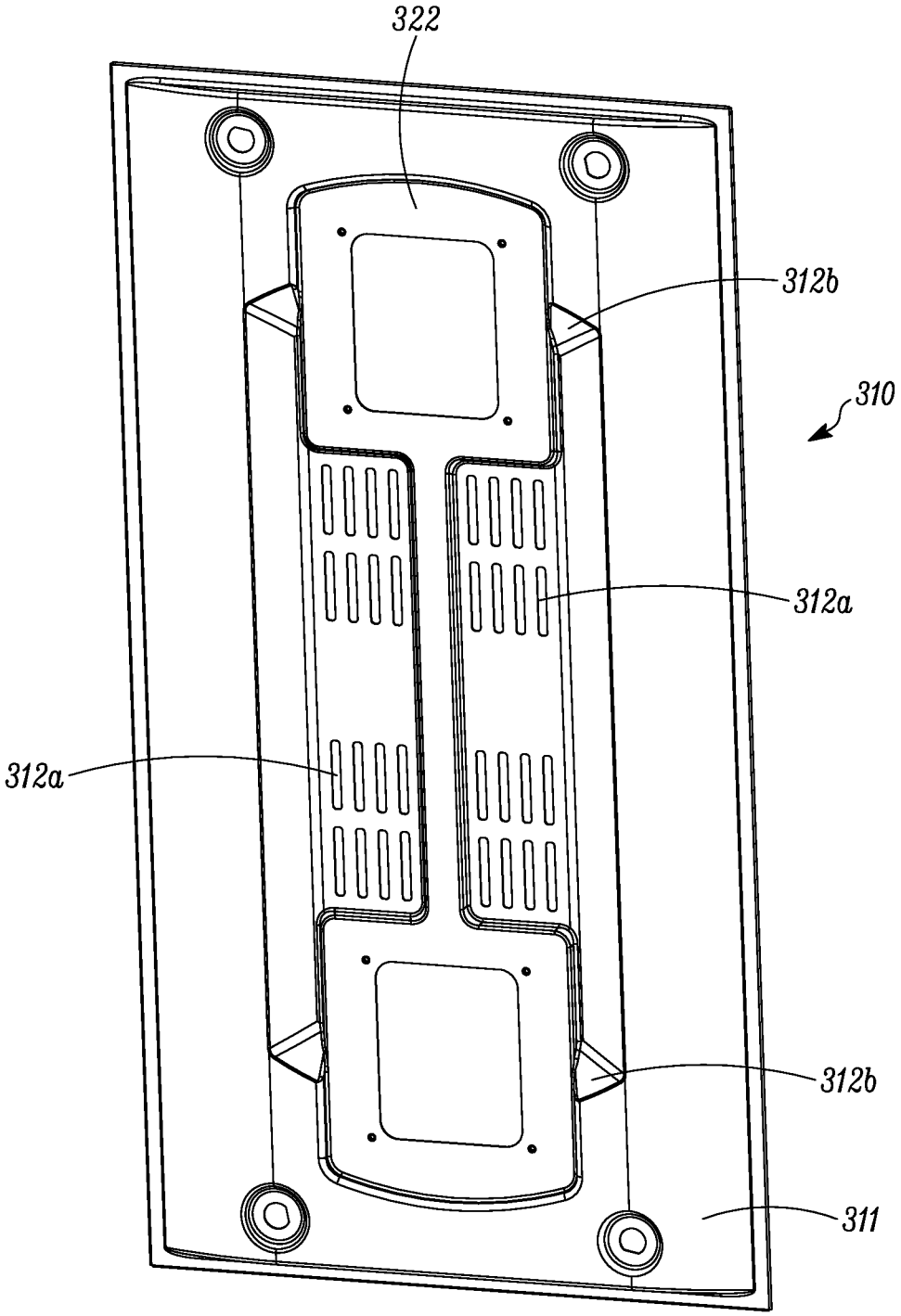

Referring to FIG. 3B, the air vent 310 in an embodiment may be configured as part of the window assembly 300 and furnace front door or access. The air vent 310 is on a base panel 311 and includes a plurality of openings 312*a*, 312*b*. The openings 312*a*, 312*b* can have various shapes and sizes. In the illustrated embodiment, for example, the openings 312*a* can resemble louvers and the opening 312*b* can be apertures punched on the base panel 311.

Figure 3C:
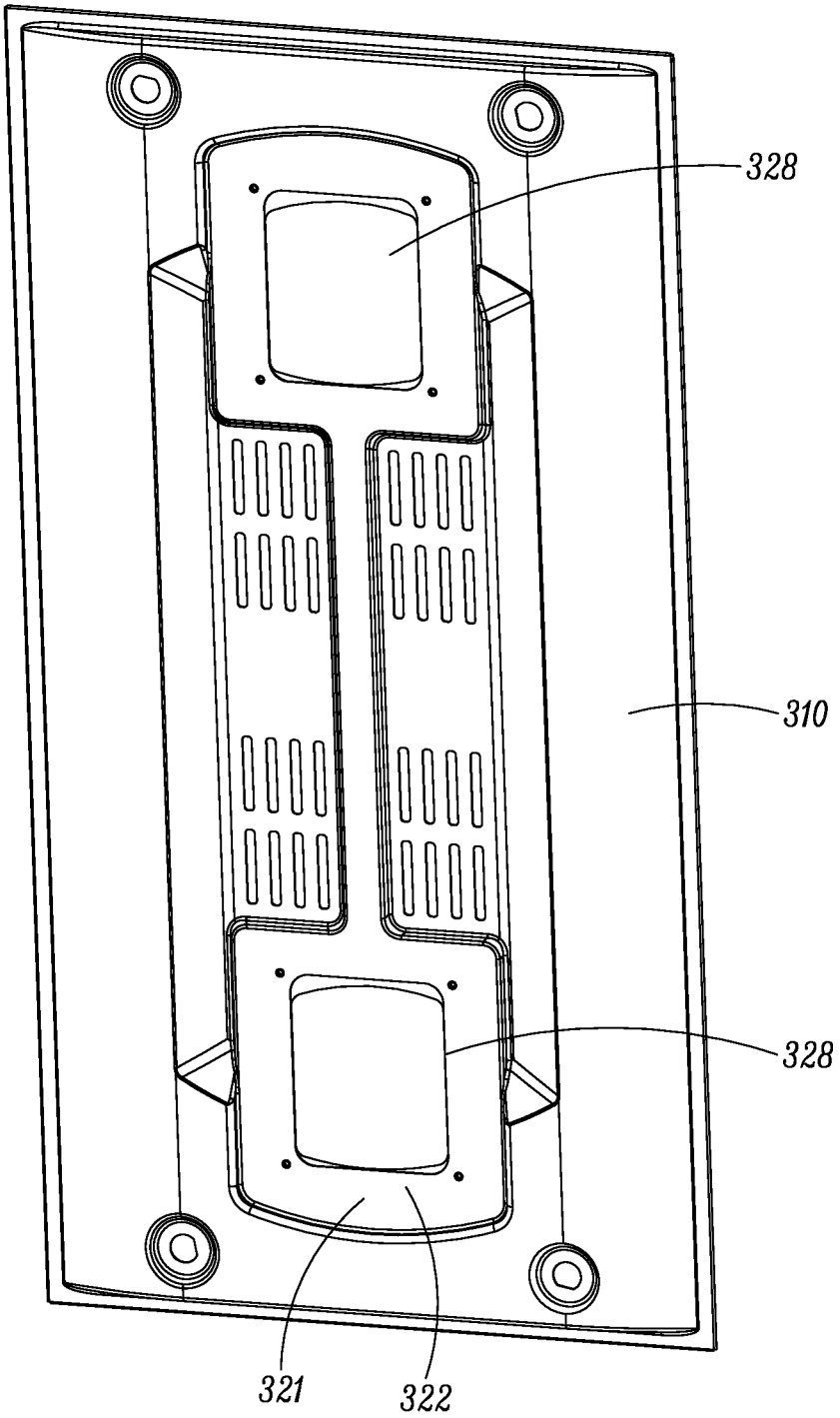
Figure 3D:
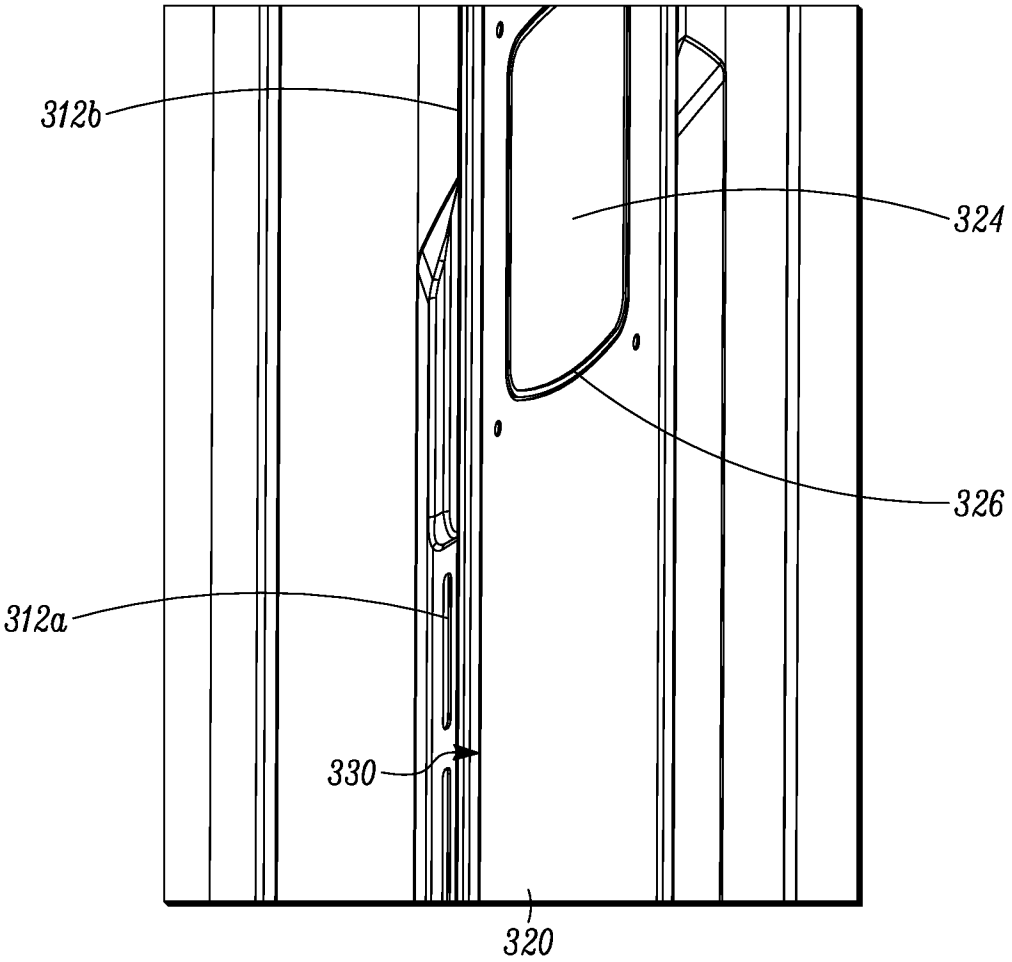

The air vent 310 includes a viewing window support 322 that is configured to support the viewing window panel 320. Relative to the viewing window support 322, the openings 312*a*, 312*b* are recessed. Referring to FIGS. 3B, 3C and 3D together, the recessed openings 312*a*, 312*b* allow the openings 312*a*, 312*b* to be covered (or hidden from view) by the viewing window panel 320, giving a cleaner appearance while still permitting airflow through a gap 330 (as illustrated in FIG. 3D) between the viewing window panel 320 and the openings 312*a*, 312*b*. The airflow can be directed to the burner to help burn gas.

Referring to FIGS. 3A, 3C and 3D, details of the viewing window panel 320 are further described. The viewing window panel 320 can include a frame 326 that is configured to hold at least one window or glass 324. The frame 326 can be attached to the viewing window support 322 on areas 321 of the viewing window support 322. In an embodiment, openings 328 of the viewing window support 322 are sized to match with the size of the windows 324.

In the illustrated embodiments, the viewing window panel 320 includes two windows 324, which can provide different views into the furnace when installed. It is to be understood that a number, shapes and sizes of the windows 324 can be varied to meet design requirements.

In the illustrated embodiments, the window 324 is tinted so that the window 324 generally appears to have a dark color, but a flame of the burner or a LED display (e.g. a LED display showing error messages) inside the furnace can be viewed through the window 424. The tinted window 324 can hide internal components of a furnace, allowing a cleaner appearance and desirable aesthetic appearance.

It is to be appreciated that the tinted window 324 can be used separately from the air vent 310.

An enclosure (e.g. the enclosure 210 in FIG. 2) typically has a door to cover the space inside the enclosure. The air vent 310 as disclosed herein can be configured, for example onto a door or other panel(s) of a furnace enclosure.

Figure 4A:
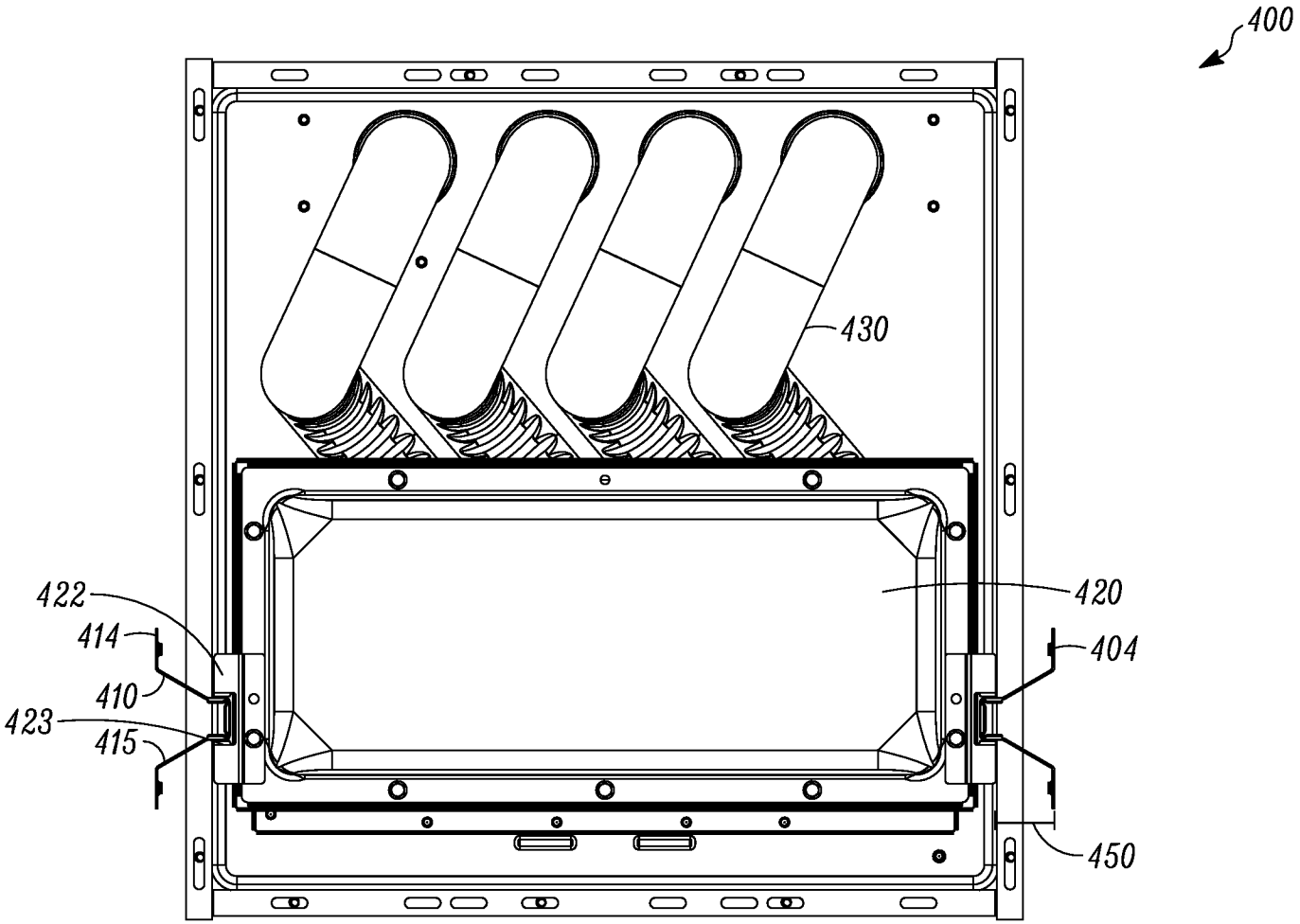
FIGS. 4A to 4B illustrate a rail for a removable heat exchanger system.
Figure 4B:
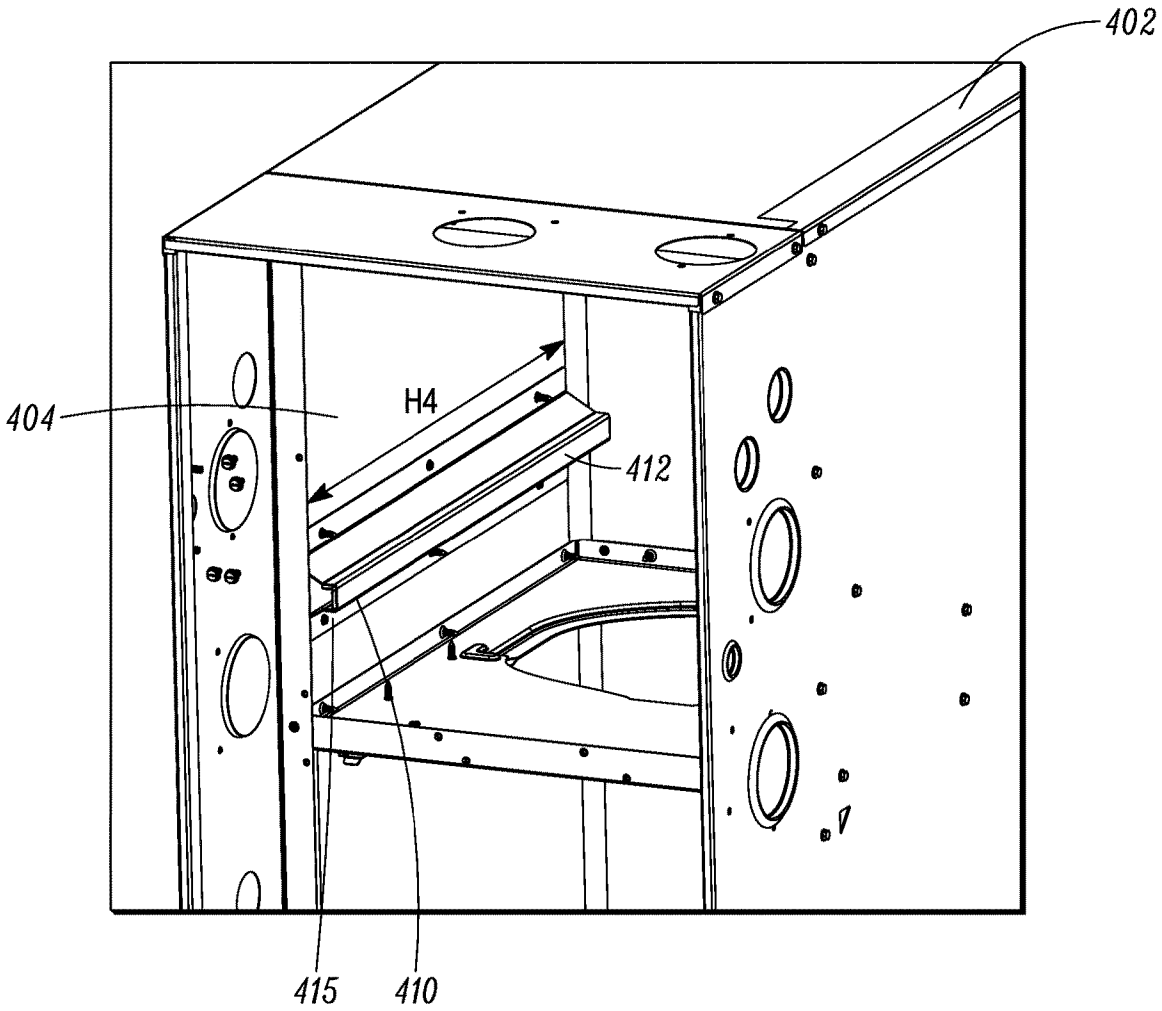

FIGS. 4A to 4B illustrate a rail 410 for a removable heat exchanger system 400. The rail 410 can be implemented for example with the heat exchanger system 140 and on the enclosure 210 of FIGS. 1 and 2. The removable heat exchanger system 400 includes a heat exchanger support 422 that is attached to (or integrated into), for example, a header 420 of a heat exchanger 430 and the rail 410.

The rail 410, as illustrated in FIG. 4B, has flanges 414 attached to a panel 404 of an enclosure 402 (e.g. a side panel of the heat exchanger compartment). The rail 410 can be extended on the panel 404 in a horizontal direction and have a length H4.

Referring to FIG. 4A, the heat exchanger support 422 includes a notch 423 that can engage the rail 410, and the engagement can support the heat exchanger 430. The heat exchanger support 422 can, for example, be a separate piece attached to (or can be integrated with) a header 420 of the heat exchanger 430. The heat exchange support 422 can slide on the rail 410 in the horizontal direction. FIG. 4A shows two rails on opposite sides of the enclosure.

The rail 410, in some embodiments, may be made of various materials, such as for example sheet metal or plastic. In some embodiments, the rail 410 can be designed to attach to a panel of an enclosure. In some embodiments, the rail 410 can be integrated into, for example, a panel of an enclosure. In some embodiments, the heat exchanger support 422 may be an attached part to the heat exchanger 430 that can slide on the support portion 412 of the rails 410.

Referring to FIG. 4A together, the rail 410 can have a sloped baffle portion 415 connected to the flange 414. The sloped baffle portion 415 can help block and in some cases reflect airflow (e.g. airflow from a blower) back toward a center of the compartment, which can help reduce/prevent airflow leakage from a gap 450 between the panel 404 and a side of the header 420.

Figure 5A:
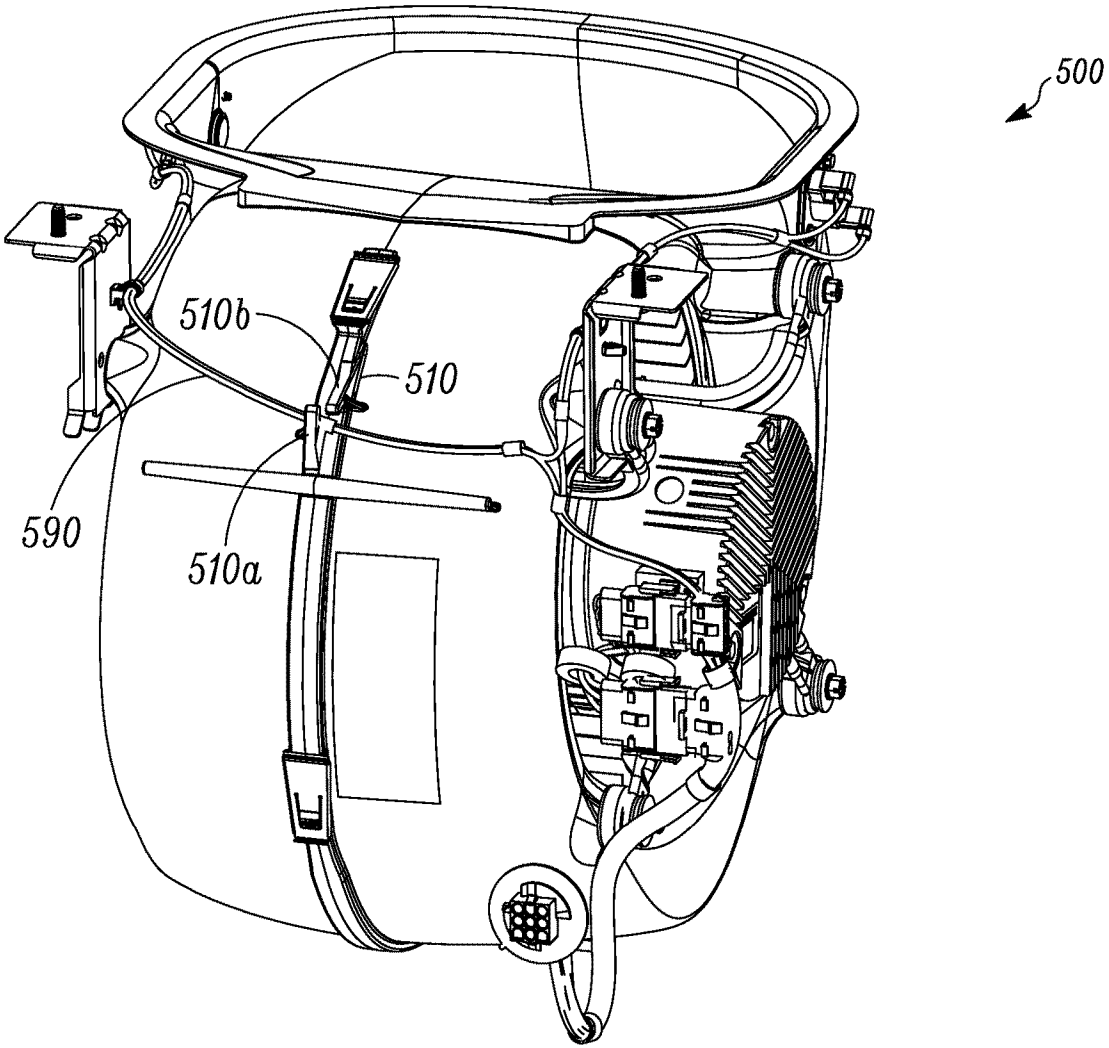
FIGS. 5A to 5C illustrate a wire retaining fin assembly to retain a wire.
Figure 5B:
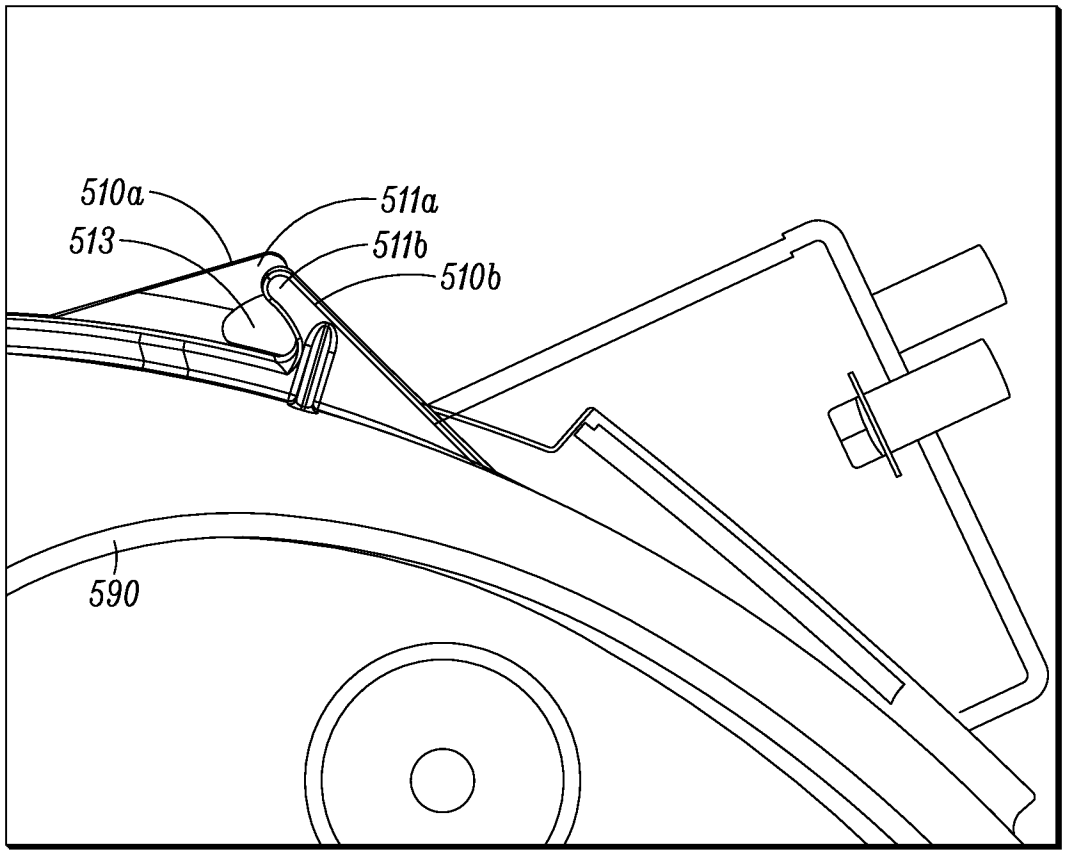
Figure 5C:
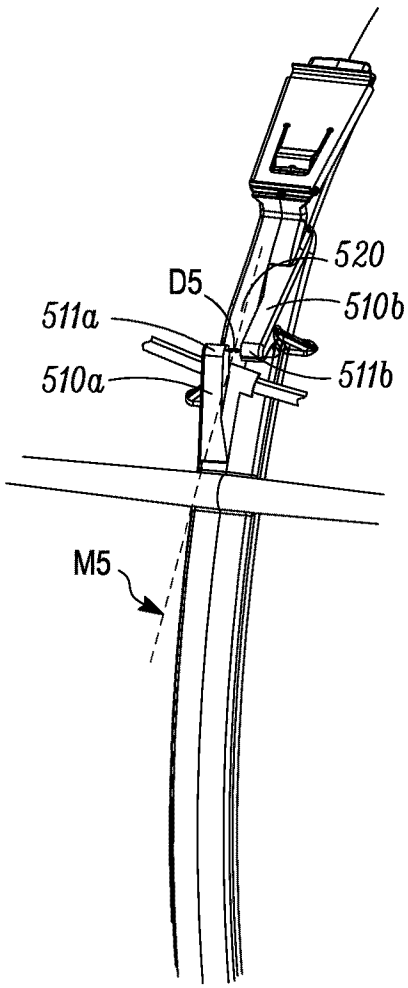

FIGS. 5A to 5C illustrate a wire retaining fin assembly 510 that can be used to retain a wire 590, for example, on a housing of a blower system 500. The wire retaining fin assembly 510 can help maintain the position of the wire 590, such as for example during the operation of the blower 500 system.

Referring to FIGS. 5B to 5C, the wire retaining fin assembly 510 includes a first fin 510*a* and a second fin 510*b*. The first and second fins 510*a*, 510*b* have a first tip 511*a* and a second tip 511*b* respectively. The first and second fins 510*a*, 510*b* are arranged so that the first tip 511*a* and the second tip 511*b* face each other, while the first and second tips 511*a*, 511*b* are offset relative to a divide line M5 (as illustrated in FIG. 5C). In the illustrated embodiment, the first tip 511*a* and the second tip 511*b* also cross or overlap each other from the side view as illustrated in FIG. 5B. The offset first and second fins 510*a*, 510*b* have an offset space 520 with a distance D5, as illustrated in FIG. 5C. The distance D5 is sized so that the distance D5 can allow the wire 590 to pass through.

Referring to FIG. 5B, curvatures of the first and second fins 510*a*, 510*b* can define a retaining space 513, which may be sized and shaped to accommodate the wire 590.

When the wire 590 is installed to the blower, the wire 590 can be firstly positioned in the offset space 520 between the first and second fins 510*a*, 510*b*. The wire 590 can then be twisted about, for example, 90 degrees so that the wire 590 is retained in the wire retaining space 513. Installation of the wire 590 to the wire retaining fin assembly 590 is relatively easy, and the wire 590 can be held in place securely.

The first and second fins 510*a*, 510*b* can be molded into the housing of the blower system 500, eliminating the need to use wire ties, clips, or clamps to secure the wire 590. It is to be understood that the wire retaining fin assembly 510 as disclosed herein can also be used with other component(s) of the furnace.

It is to be appreciated that a profile of a first fin 510*a* and a second fin 510*b* may be configured so that a material (e.g. fiberglass) may flow into a region(s) corresponding to the first and second fins 510*a*, 510*b* in the mold.

It is to be appreciated that by positioning and orienting the wire retaining fin assembly 510, the wire can be directed into a desired direction.

Figure 6A:
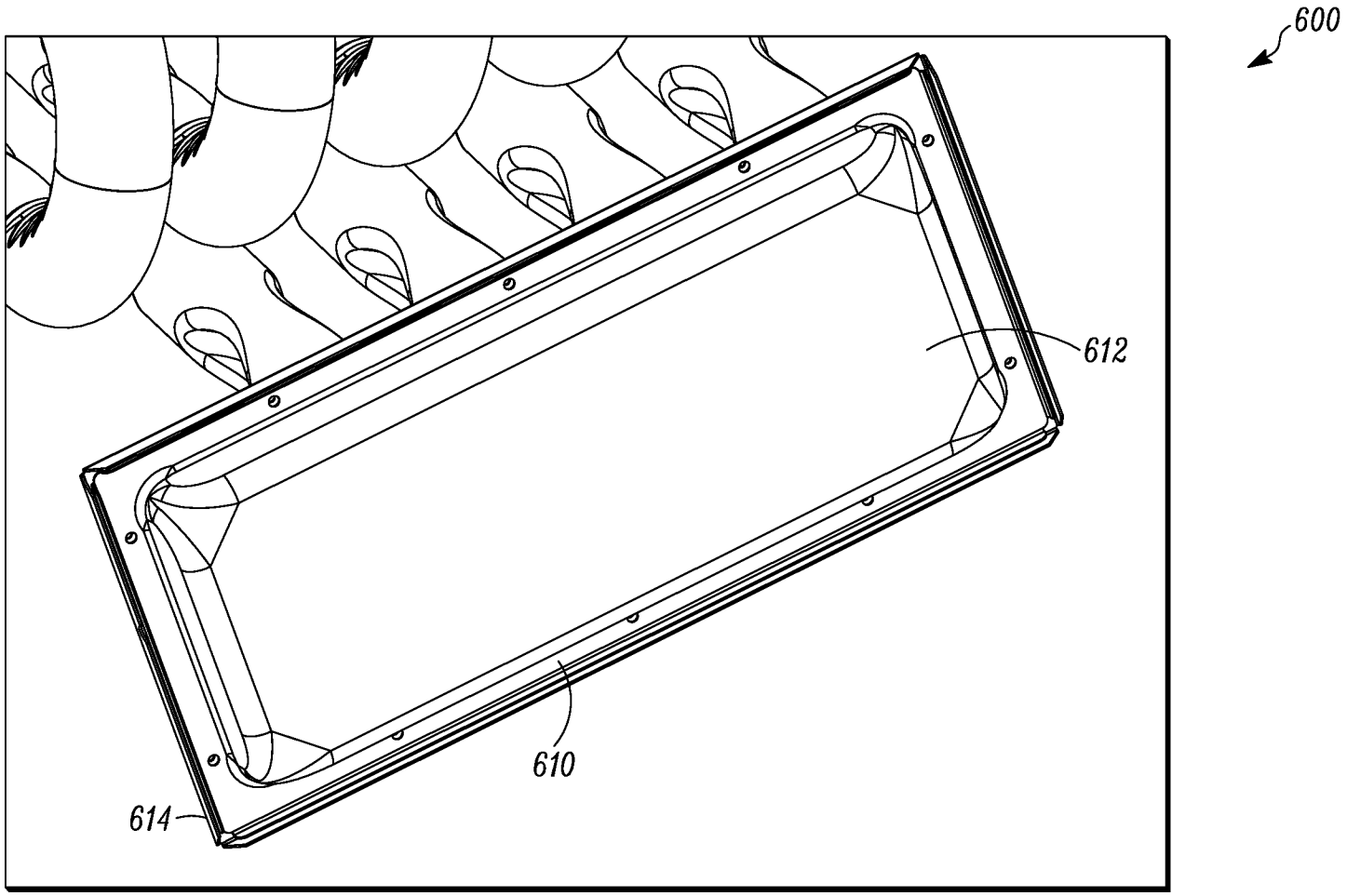
FIGS. 6A to 6C illustrate a heat exchanger header.
Figure 6B:
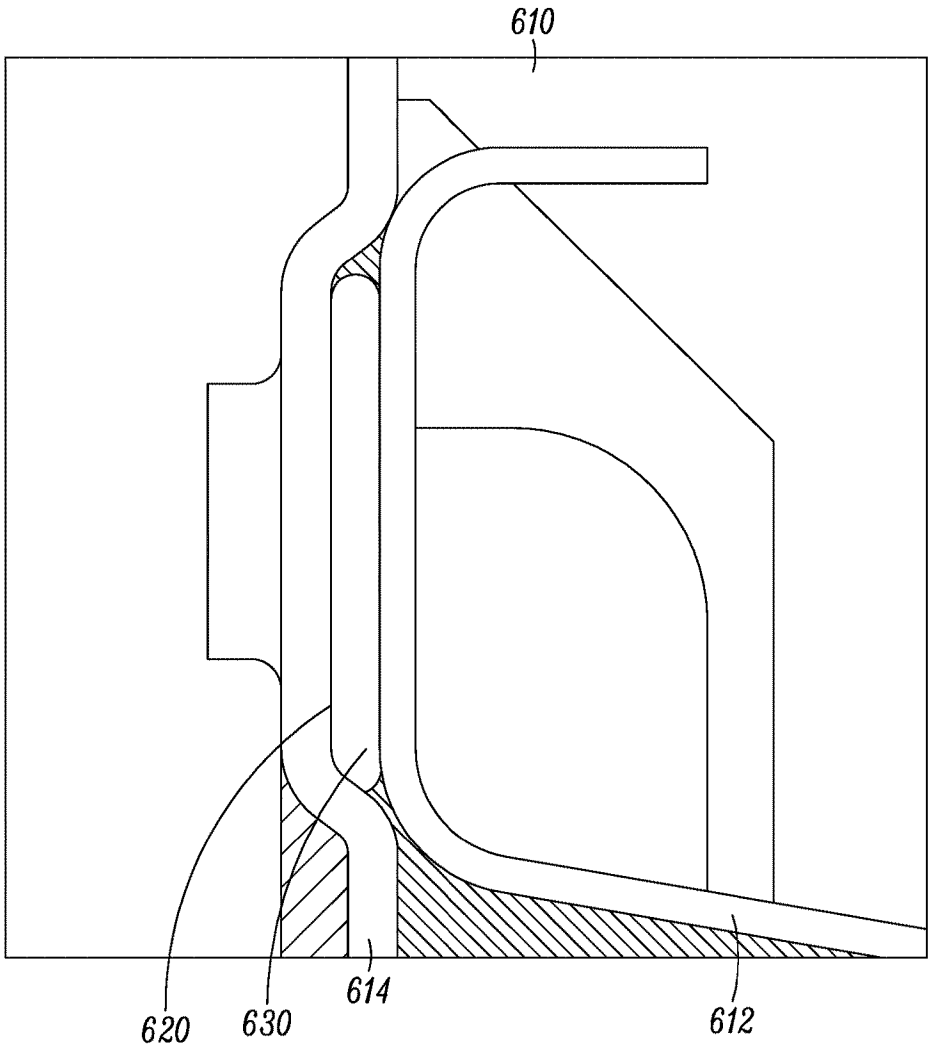
Figure 6C:
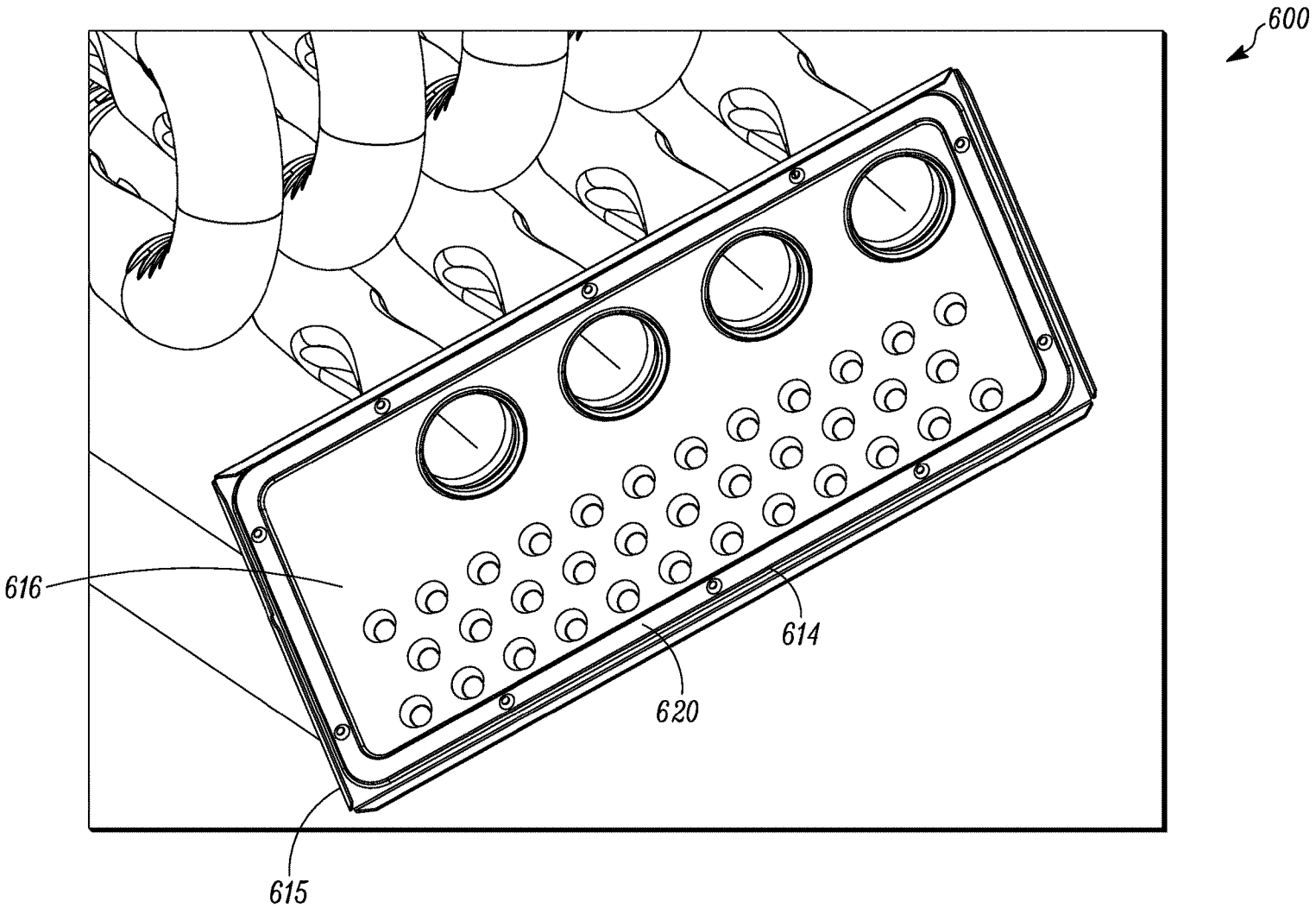

FIGS. 6A to 6C illustrate a header 610 of a heat exchanger 600 (e.g. a secondary heat exchanger) of a furnace, according to one embodiment. The header 610 may include a cover 612 and a base 614. In an embodiment, the cover 612 and the base 614 form an airtight seal. In some cases, the airtight seal is formed to withstand a relatively high temperature.

Referring to FIGS. 6B and 6C, the base 614 includes a recessed region 620 close to an outer edge 615 of the base 614. The recessed region can be configured to encircle a tube installation region 616 of the base. The tube installation region 616 is a region on the base 614 that is configured to receive an end of heat exchanger tubes.

As illustrated in FIG. 6B, the recessed region 620 can help retain a sealant 630 when the cover 612 engages the base 614. During installation, the recessed region 620 can function as a cavity that a sealant in various forms (e.g. a liquid, a paste, or a gummy composition) can settle into. When the cover 612 and the base 614 are pressed against each other, the recessed region 620 creates a channel of sealant that prevent the sealant 630 from being squeezed out, which helps increase the reliability of the sealant.

It is to be appreciated that a recessed region can also be positioned on the cover, or both the cover and the base may have the recessed regions.

It is to be appreciated that the features disclosed herein may be combined or modified as needed to, for example, meet design requirements.

ASPECTS

Aspect 1: An enclosure of a furnace, comprising:

a heat exchanger compartment;

a blower compartment; and a combustion compartment; wherein the combustion compartment is separated from the heat exchanger compartment by a panel of the heat exchanger compartment, the combustion compartment is separated from the blower compartment by a panel of the blower compartment form a vertical support column within the enclosure, and the panel of the heat exchanger compartment and the panel of the blower compartment are aligned to form a vertical support column within the enclosure.

Aspect 2: The enclosure of aspect 1, wherein a height of the combustion compartment is the same as a combined height of the combustion compartment and the blower compartment.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

The invention claimed is:

1. A furnace, comprising a burner system;

a heat exchanger system; and a blower system, wherein the heat exchanger system includes:

a heat exchanger;

a heat exchanger support, attached to a header of the heat exchanger; and a first rail, located on a first side wall of the heat exchanger system; and a second rail, located on a second side wall of the heat exchanger system;

wherein the heat exchanger support includes a notch configured to engage the rail, the first side wall is opposite the second side wall, and the heat exchanger support is configured to be slidable along the first and second rails.

2. The furnace of claim 1, wherein at least one of the first rail and the second rail includes one or more flanges, and at least one of the one or more flanges is connected to the first side wall or the second side wall.

3. The furnace of claim 1, wherein at least one of the first rail and the second rail is integral with a panel of the first side wall or the second side wall of the heat exchanger system.

4. The furnace of claim 2, wherein the heat exchanger system further includes a baffle connected to at least one of the one or more flanges, wherein the baffle is configured to direct airflow towards a center of the enclosure of the heat exchanger system.

5. The furnace of claim 1, wherein the heat exchanger support is slidable along the first and second rails in a horizontal direction.

* * * * *